US006743080B2

(12) United States Patent
Truong

(10) Patent No.: US 6,743,080 B2
(45) Date of Patent: Jun. 1, 2004

(54) METHOD FOR SEASONING A POLISHING PAD

(75) Inventor: Phillip P. Truong, Vancouver, WA (US)

(73) Assignee: SEH America, Inc., Vancouver, WA (US)

( * ) Notice: Subject to any disclaimer, the term of this patent is extended or adjusted under 35 U.S.C. 154(b) by 0 days.

(21) Appl. No.: 10/207,963

(22) Filed: Jul. 31, 2002

(65) Prior Publication Data

US 2004/0023597 A1 Feb. 5, 2004

(51) Int. Cl.[7] ..... B24B 1/00

(52) U.S. Cl. ..... 451/56; 451/285; 451/41; 451/28

(58) Field of Search ..... 451/56, 5, 10, 451/28, 41, 285–288

(56) References Cited

U.S. PATENT DOCUMENTS 5,547,417 A 8/1996 Breivogel et al.
5,990,012 A 11/1999 Robinson et al.
6,126,528 A * 10/2000 Sedlock ..... 451/390
6,126,532 A 10/2000 Sevilla et al.
6,200,901 B1 3/2001 Hudson et al.
6,241,584 B1 * 6/2001 Aoki ..... 451/41
6,257,961 B1 7/2001 Suzuki et al.
6,277,015 B1 8/2001 Robinson et al.
6,361,407 B1 * 3/2002 Lu et al. ..... 451/41
6,364,749 B1 * 4/2002 Walker ..... 451/41
6,409,581 B1 * 6/2002 Robinson et al. ..... 451/59

* cited by examiner

*Primary Examiner*—Lee D. Wilson
(74) *Attorney, Agent, or Firm*—Oliff & Berridge, PLC

(57) ABSTRACT

A method of preparing a polishing pad of a hydrophobic material for a polishing procedure includes, prior to the polishing procedure, contacting the polishing pad with a solution of at least one component for converting at least a portion of a polishing surface, including pores therein if porous, of the polishing pad from hydrophobic to hydrophilic, and maintaining the polishing pad in a wet state between the contacting step and the polishing procedure. New hydrophobic polishing pads are thus efficiently seasoned (broken in) for subsequent use in planarizing a semiconductor substrate surface.

20 Claims, No Drawings

METHOD FOR SEASONING A POLISHING PAD

BACKGROUND OF THE INVENTION

1. Field of Invention

The invention relates to the field of polishing pad seasoning, and in particular to the seasoning of hydrophobic semiconductor polishing pads used in the planarization of semiconductor substrates.

2. Description of Related Art

Chemical mechanical polishing (CMP) or planarization is a technique whereby surfaces, such as semiconductor substrate surfaces, are planarized by the simultaneous application of both a chemical etching and a mechanical polishing process. Planarization is typically used to globally planarize surfaces such as the upper surface of a semiconductor wafer. The wafer is typically held upon a carrier surface by any suitable means and is rotated with respect to a polishing pad. A polishing slurry containing abrasive particles, an etchant and/or other suitable polishing materials is introduced between the polishing pad and the surface of the semiconductor wafer that is to be planarized. The combination of the mechanical polishing and the etchant results in the exposed surfaces of the wafer being removed by the process.

Most commercially available polishing pads are comprised of hydrophobic materials. These substances include polyurethanes, amines, organic polymers, and resins. Planarizing pads are usually composed of polyurethane. Polyurethane is typically utilized because urethane chemistry allows the pad characteristics to be tailored to meet specific mechanical properties.

Before being employed in planarization, such polishing pads must be seasoned or conditioned, i.e., broken in. If the polishing pads are used in planarization without first being seasoned, many problems result. One of the main problems is that the polishing pads, being hydrophobic, do not initially or readily wet with the polishing solution added in the planarization procedure. This results in uneven distribution of the polishing solution, and therefore uneven polishing of the wafer surface, and may also result in scratching of the surface of a significant number of wafers. An uneven or scratched wafer is not useable in the manufacture of semiconductors as such results in damage to the devices and structures formed on the semiconductor wafer.

Several techniques are known in the art to attempt to address the problems created by using hydrophobic polishing pads. For example, U.S. Pat. No. 5,547,417 describes a method of polishing a thin film formed on a semiconductor substrate. During polishing, the polishing pad is continually conditioned by forming a plurality of grooves into the polishing pad. The grooves are formed by a conditioning block having a substantially planar bottom surface with a plurality of groove generating points extending from the substantially planar surface of the conditioning block. The grooves are generated by sweeping and rotating the conditioning block between an outer radius and an inner radius of the polishing pad.

U.S. Pat. No. 6,126,532 describes a polishing pad for polishing a semiconductor wafer that includes an open-celled, porous substrate having sintered particles of synthetic resin. The porous substrate is a uniform, continuous and tortuous interconnected network of capillary passages. The pores of the porous substrate have an average pore diameter of from about 5 to about 100 microns that enhances pad polishing performance. It is described that the polishing pad is conditioned before use according to a buffing method that mechanically conditions the top pad surface and converts the top pad surface from hydrophobic to hydrophilic.

Such mechanical seasoning methods are typical in the art. However, these methods require both time and additional processing steps, and thus are expensive to perform. For example, a method for breaking in new polishing pads might typically comprise laying the new polishing pads, subjecting the pads to a water brush, then to a polishing slurry brush, and then followed by several to many hours of dummy wafer runs, before employing the polishing pads to polish prime production wafers. Moreover, the occurrences of polishing scratches and haze, and thus yield loss, even after such mechanical seasoning of the polishing pads, can remain high for many hours or days.

U.S. Pat. No. 6,200,901 describes methods of oxidizing the surface of a photoresist material on a semiconductor substrate to alter the photoresist material surface to be substantially hydrophilic. Oxidation of the photoresist material surface substantially reduces or eliminates initial sticking between a planarizing pad and the photoresist material surface during chemical mechanical planarization. This oxidation of the photoresist material may be achieved by oxygen plasma etching or ashing, by immersing the semiconductor substrate in a bath containing an oxidizing agent, or by the addition of an oxidizing agent to the chemical slurry used during planarization of the resist material. This patent thus describes altering the wafer surface to assist in planarization.

U.S. Pat. Nos. 5,990,012 and 6,277,015 describe a method of chemical-mechanical polishing of a surface of a semiconductor substrate by providing a fixed-abrasive polishing pad; providing a surface to be polished; and providing a chemical polishing solution containing a surface tension-lowering agent that lowers the surface tension of the solution from the nominal surface tension of water to a surface tension that sufficiently wets a hydrophobic surface to be polished such that chemical-mechanical polishing is accomplished. The patents also describe pad improvements that mechanically sweep the polishing solution under the pad or that receive polishing solution from the back of the pad such that a tangential and radial shear is placed on the polishing solution as it flows away from the pad. These patents thus focus on the composition of the polishing solution.

U.S. Pat. No. 6,364,749 describes an improved CMP polishing member having a plurality of protrusions with an outer surface, the outer surface of the protrusions defining a polishing surface of the CMP pad adapted to polish or planarize an exposed surface of a semiconductor wafer. A plurality of cavities interposed between the protrusions and the cavities have a hydrophilic surface so as to attract wetting solution to thereby enhance retention of the wetting solution adjacent the polishing interface between the surface of the semiconductor wafer and the polishing surface of the polishing pad. In one embodiment, the protrusions are comprised of a fixed abrasive material, such that the polishing pad is a fixed abrasive polishing pad. In another embodiment, the cavities between the protrusions are coated with a hydrophilic material so as to retain wetting solution immediately adjacent the exposed surfaces of the fixed abrasive protrusion. The protrusions can either be in the form of a plurality of discrete protrusions formed on a first surface of a substrate of a semiconductor wafer or, alternatively, can be comprised of a plurality of spiral protrusions.

What is still desired is a simplified method for seasoning new hydrophobic polishing pads prior to use in planarizing semiconductor wafers, which method renders at least the polishing surface of polishing pad hydrophilic so as to improve polishing and reduce polished semiconductor substrate yield loss, and which method is less time consuming and less expensive than conventional mechanical seasoning methods.

SUMMARY OF THE INVENTION

In a first aspect of the present invention, the invention relates to a method of preparing a polishing pad comprised of a hydrophobic material for a polishing procedure, comprising, prior to the polishing procedure, contacting the polishing pad with a solution comprised of at least one component for converting at least a portion of a polishing surface of the polishing pad from hydrophobic to hydrophilic, and maintaining the polishing pad in a wet state between the contacting step and the polishing procedure.

In a further aspect of the present invention, the invention relates to a method of planarizing a semiconductor substrate surface, comprising seasoning an unseasoned polishing pad comprised of a hydrophobic material by contacting the polishing pad with a solution comprised of at least one component for converting at least a portion of a polishing surface of the polishing pad from hydrophobic to hydrophilic to derive a seasoned polishing pad, maintaining the seasoned polishing pad in a wet state following the seasoning step and before contacting the seasoned polishing pad with a surface of a semiconductor substrate, and contacting the seasoned polishing pad with a surface of a semiconductor substrate to be planarized in the presence of a polishing composition to thereby planarize the semiconductor substrate surface.

DETAILED DESCRIPTION OF PREFERRED EMBODIMENTS

The first aspect of the invention relates to a method of preparing a polishing pad comprised of a hydrophobic material for a polishing procedure, comprising, prior to the polishing procedure, contacting the polishing pad with a solution comprised of at least one component for converting at least a portion of a polishing surface of the polishing pad from hydrophobic to hydrophilic, and maintaining the polishing pad in a wet state between the contacting step and the polishing procedure. The pads are also preferably rinsed following the contacting step to substantially remove the solution from the polishing pad.

The polishing pads to be processed in the present invention may comprise any known and/or suitable type of polishing pads comprised of a hydrophobic material. The hydrophobic polishing pads may be porous or non-porous, but are preferably porous, i.e., the pads contain micropores therein. These micropores are most preferably capable of holding therein a polishing composition. As discussed above, such hydrophobic polishing pads may be comprised of matrices of, for example, polyurethanes, amines, or any other suitable hydrophobic polymer. Numerous hydrophobic polishing pads are commercially available from manufacturers such as, for example, Toray Coatex, Rodel, Fujimi, etc., and include, for example, Ciegal 000 by Toray Coatex and Fujimi Surfin 000.

When new, such hydrophobic polishing pads are unseasoned. By "unseasoned" as used herein is meant that the polishing pads are new in the sense that the polishing pads have not previously been used in production of planarized semiconductor substrates. It is thus necessary, prior to employing such polishing pads in the polishing procedure that planarizes semiconductor substrates for use in semiconductor devices, to season, i.e., break in, the polishing pads. This is because, as discussed above, the polishing surface of the polishing pads, and including the pores of the polishing surface of porous polishing pads, is hydrophobic in nature as a result of the material of the polishing pad being hydrophobic. "Seasoning" as used herein refers to a process of converting at least a portion of at least the polishing surface of the polishing pad from the initial hydrophobic nature to be hydrophilic in nature. Seasoning results in the polishing pad surface being able to be readily wet by a polishing composition.

The seasoning method in the present invention comprises a chemical seasoning. In other words, the polishing surface and/or pores of the polishing surface of the polishing pad are converted from hydrophobic to hydrophilic with a chemical.

The conversion is effected by contacting the polishing pad with a solution comprised of at least one component for chemically converting at least a portion of the polishing surface of the polishing pad from hydrophobic to hydrophilic. Preferably, substantially all, e.g., greater than or equal to at least about 90%, of the polishing surface and any pores therein of the polishing pad are chemically converted to be hydrophilic. Of course, a substantial amount, including substantially all, of the polishing pad and/or pores throughout the remainder of the polishing pad (i.e., at portions other than at the polishing surface) may also be converted to be hydrophilic by the method of the present invention, although such is not necessary to obtain a polishing pad effective in planarizing a semiconductor substrate.

The component for converting at least a portion of a polishing surface of the polishing pad from hydrophobic to hydrophilic, also referred to herein as the chemical converting agent, penetrates the small spaces within the pores of the hydrophobic polishing pad, wetting down the side walls of these pores and reducing the surface tension of liquid material, allowing the liquid material to enter these pores more easily rather than forced entry through mechanical means.

Once the pores become wet, the polishing pads become hydrophilic and remain in that state as long as the polishing pads stay wet. Thus, following treatment of the hydrophobic polishing pads with the chemical converting agent, the pads should then be used to polish prime product without the pads allowed to become dry, i.e., they should be maintained in a wet state. If the polishing pads do become dry, the effectiveness of the seasoning treatment is diminished, and thus the seasoning with the chemical converting agent should be repeated in these circumstances. While the chemical converting agent may be substantially removed after the polishing pads become wet and prior to polishing the prime product so as not to interfere with the chemical mechanical processing, negatively impacting quality and thus yield, cost and productivity, the polishing pads should still remain wet even following such rinsing.

The contacting of the polishing pad with the solution may be effected through any suitable means without limitation. For example, the polishing pad may be sprayed with the solution, immersed in the solution, or even contacted with the solution during dummy runs, i.e., during operation of a polishing device employing the polishing pads but in which high quality polished semiconductor substrates are not intended to be produced. Such dummy runs may use no substrates at all (i.e., a blank run), may employ substrates other than silicon semiconductor substrates, or may employ silicon semiconductor substrates that are intended to be disposed of rather than used in subsequent manufacture of semiconductor devices.

In a preferred embodiment of the present invention, the polishing pad is contacted with the solution by soaking the polishing pad in the solution. At least the polishing surface of the polishing pad is contacted with the solution in the soaking, although preferably substantially the entire polishing pad is immersed in the solution. The soaking may be conducted before or after the polishing pads are mounted (laid) in the polishing device. The soaking is conducted for a sufficient time for the chemical conversion of at least the pores of the polishing surface of the polishing pad from hydrophobic to hydrophilic to be completed. Such time may be from, for example, about 15 minutes to about 3 hours, preferably about 30 minutes to about 90 minutes, and most preferably about 50 to about 70 minutes.

Of course, the time required for the polishing pad to be in contact with the solution in order for the conversion to be completed may vary depending on the composition of the hydrophilic conversion solution. For example, a solution containing a greater concentration of the component for converting at least the polishing surface of the polishing pad from hydrophobic to hydrophilic may take less time to effect such conversion compared to a solution having a lesser concentration of such component.

The hydrophilic conversion solution used to effect the conversion of the polishing pad from hydrophobic to hydrophilic must comprise at least one component for converting at least a portion of the polishing surface of the polishing pad from hydrophobic to hydrophilic. The solution may be comprised solely of such component (i.e., 100% of the chemical converting agent). However, in a preferred embodiment, the solution comprises such component dispersed/dissolved in a suitable solvent. Preferably, the solution may include water (preferably deionized).

Thus, the solution may comprise from about 5% to 100% by weight, preferably about 5% to about 75%, and more preferably about 10% to about 30%, of the at least one component for converting at least the polishing surface of the polishing pad from hydrophobic to hydrophilic.

The at least one component for converting at least a portion of the polishing surface of the polishing pad from hydrophobic to hydrophilic may comprise any suitable material without limitation. Typically, of course, such component itself possesses hydrophilicity, and thus the component may comprise any suitable hydrophilic material or polymer. Most preferably, it has been found that an alcohol based material or polymer, or oxidizer or amines, is a suitable component for effecting the conversion from hydrophobic to hydrophilic. Generally, any material or agent that has lower surface tension than water is a suitable component for the chemical converting agent. Most preferably, the alcohol is isopropyl alcohol. When utilizing alcohol(s) as the component, the alcohol(s) may be present in the solution, which preferably includes water as a solvent, in an amount of from about 5% to about 75% by weight, more preferably about 10% to about 30% by weight. The higher the concentration of the chemical converting agent, the more effective it is for converting the polishing pads from hydrophobic to hydrophilic. For example, straight isopropyl alcohol may be used without diluting with water.

Following the conversion of at least the polishing surface of the polishing pad from hydrophobic to hydrophilic, the solution may be rinsed from the polishing pad and/or pores thereof. If the chemical converting agent interferes with chemical mechanical polishing, resulting in poor product quality, then it should be substantially removed prior to polishing product material. However, it is not necessary to remove the chemical converting agent if such does not interfere with any component of chemical mechanical polishing.

If the rinsing removes substantially all of the chemical converting agent, it is meant that almost all, e.g., 90% or more, of the chemical converting agent is removed from the hydrophobic polishing pad and pores thereof. However, a minor amount, i.e., an amount sufficient to provide wetting of the hydrophobic polishing pad and pores thereof but insufficient to adversely affect the chemical mechanical processing in a significant manner, of the chemical converting agent may remain.

Although any rinsing agent may be used, deionized water is preferably used as the rinsing agent.

The rinsing may be effected in any suitable manner without limitation. In a preferred embodiment of the present invention, the rinsing is effected through employment of a conventional water brush operation. In such operation, the polishing surface of the polishing pad is contacted with a brushing device in the presence of the rinsing agent. The brushing device may include, for example, a pad, a bristle brush or ultrasonics. The deionized water may be supplied by any manner to the area of contact between the brushing device and the polishing surface of the polishing pad. The combination of the agitation and the rinsing agent acts to remove substantially all of the solution from at least the polishing surface, and pores thereof, of the polishing device, and preferably from substantially all of the entire polishing pad.

Where the polishing pads are mounted in the polishing device, the rinsing may be effected by running/rotating the device over the brushing device while supplying the rinsing agent thereto.

The rinsing should be continued for a time sufficient to substantially remove all of the solution from at least the polishing surface of the polishing device. For example, the rinsing may be conducted for about 1 minute to about 1 hour, preferably for about 5 minutes to about 30 minutes.

If rinsing is performed, once the polishing pads are rinsed, the polishing pads are then ready for use in polishing/planarizing of semiconductor substrates, e.g., silicon wafers. Again, the polishing pads should not be allowed to become dry following the rinsing before use in polishing semiconductor substrates.

Prior to use in such polishing procedure, it is preferable to subject the polishing pads to a further processing step in which the desired polishing composition (also referred to as a polishing slurry) is driven into the polishing pad, e.g., into the pores of a porous polishing pad at least at the polishing surface of the polishing pad.

This can be accomplished by any suitable method. In particular, any method that suitably contacts the polishing pad with a polishing composition in order to drive such polishing composition into the porous polishing pad may be used. For example, the contacting of the polishing pad with a polishing composition may comprise contacting the polishing surface of the polishing pad with a brushing device (e.g., a pad or bristle brush as above) in the presence of the polishing composition. Also, the contacting of the polishing pad with a polishing composition may comprise conducting the polishing procedure with the polishing pad in the presence of the polishing composition. This includes conducting dummy runs in the same manner as discussed above, but in the presence of the polishing composition rather than the hydrophilic conversion solution. When such run is conducted without any wafers present, the polishing procedure is referred to as being conducted on a blank run.

The polishing pads may be contacted with the polishing composition for any suitable amount of time without limitation. In order for the polishing solution to be suitably driven into the porous polishing pad, the contact is preferably maintained for at least about 30 minutes, and preferably from about 30 minutes to about 3 hours, more preferably from about 1 hour to about 2 hours.

In a most preferred aspect of the present invention, porous hydrophobic polishing pads are seasoned prior to use in polishing semiconductor substrates by soaking the polishing pad in an aqueous solution containing about 20% by weight isopropyl alcohol for about 1 hour, then subjecting the polishing pad to a water brush with deionized water for about 20 minutes, followed by running a polishing device with the pads but without any semiconductor substrates (blank run) in the presence of a polishing composition for about 2 hours.

In a further aspect of the present invention, the invention relates to a method of planarizing a semiconductor substrate surface, comprising seasoning an unseasoned polishing pad comprised of a hydrophobic material by contacting the polishing pad with a solution comprised of at least one component for converting at least a portion of a polishing surface of the polishing pad from hydrophobic to hydrophilic and thereafter rinsing the polishing pad to substantially remove the solution from the polishing pad to derive a seasoned polishing pad, and contacting the seasoned polishing pad with a surface of a semiconductor substrate to be planarized in the presence of a polishing composition to thereby planarize the semiconductor substrate surface.

As the polishing composition, any composition used, or developed in the future for use, in CMP or planarization processes may be employed without restriction. As known in the art, such polishing compositions may employ at least an etchant (a chemical etchant) and an abrasive material (e.g., abrasive particles for mechanical planarizing of the semiconductor substrate surface).

As the polishing device, upon which the polishing pads are mounted/laid for carrying out the polishing procedure, and polishing procedure, any suitable polishing device and polishing procedure may be used without limitation. In this regard, see, for example, U.S. Pat. No. 6,200,901 and U.S. Pat. No. 6,257,961, both incorporated herein by reference in their entireties. As detailed in U.S. Pat. No. 6,257,961, polishing devices include any device known in the art that contains a rotating turntable that rotates in carrying out the polishing procedure. The polishing device may be, for example, a single-side polisher or a double-side polisher, both of which are known in the art. For example, single-side chemical mechanical polishing processes for silicon and other semiconductor wafers may be carried out on a polishing device in which a batch of semiconductor wafers are mounted upon a carrier through a mounting medium. A batch of wafers typically includes, for example, 4 to 10 wafers. The mounting medium may be either a wax or any of several waxless mounting media, such as a vacuum, which provide means for adhering the wafers to the carrier. The carrier is preferably mounted through a resilient pressure pad, for example an air bag, to a pressure plate that, in turn, is suitably mounted to elements capable of rotation. Opposite the surface of the carrier upon which the wafers are mounted, the polishing pad is mounted upon a turntable. During polishing, the turntable is rotated and brought into contact with the wafers at a pressure that may be modified with the air bag pressure or the contact force. When the polishing pad and wafers are in rotatable contact during polishing, the turntable forces rotation of the carrier through friction means, or the carrier may be rotated via independent drive means. Temperature control, e.g., cooling, means may also be provided in association with the turntable in order to regulate the temperature of the polishing device environment.

The invention will be further explained by way of the following example. This example is provided for further illustration of the invention, and is not intended to act as a limiting factor on the scope of the claimed invention.

To demonstrate the efficiency and effectiveness of the present chemical method of converting pores of a hydrophobic polishing pad to be hydrophilic, a method of the invention is compared to a conventional physical seasoning method utilizing the same porous hydrophobic polishing pads.

Two different silicon wafer types are used in the comparison. Mainly, P− and P+ type wafers are used.

In the method of the invention, the following procedure is followed: (1) lay the pads in the polishing device, (2) water brush with deionized water for 5 minutes, (3) spin off water, (4) soak in an aqueous solution containing about 20% by weight isopropyl alcohol for about 60 minutes, (5) water brush with deionized water for 20 minutes, (6) run a blank run for 2 hours. The polishing pads are then used to polish the indicated wafers.

In the comparative physical seasoning method, the following procedure is followed: (1) lay the pads in the polishing device, (2) water brush with deionized water for 5 minutes, (3) brush in the presence of the polishing slurry for about 5 minutes, and (4) conduct dummy runs for 3 hours. The polishing pads are then used to polish the indicated wafers.

The results are summarized in the following Table.

TABLE

| | Physical Seasoning | | Invention | |
|---|---|---|---|---|
| Parameter | P− | P+ | P− | P+ |
| # lots | >1000 | >1000 | >1000 | >1000 |
| mean % scratched | A | ~2 A | ~0.5 A | ~A |
| std dev % scratched | B | ~2 B | ~0.5 B | ~B |
| Pad life | C | | >1.2 C | |
| Wafer haze | D | | (0.6–0.7) D | |
| Wafer surface roughness | E | | ~0.75 E | |

As can be seen from the Table, the seasoning method of the invention results in lower yield loss of polished semiconductor substrates, i.e., a lower number and percentage of scratched wafers that are not useable to make semiconductor devices. The chemical procedure of the present invention thus effectively and efficiently improves the seasoning of hydrophobic semiconductor polishing pads, and results in wafers polished with the seasoned pads that (1) are scratched in lesser amounts, (2) exhibit less haze and (3) exhibit lower surface roughness, compared to polishing with physically seasoned pads. In addition, the method eliminates the use of dummy wafers and increases pad life.

What is claimed is:

1. A method of preparing a polishing pad comprised of a hydrophobic material for a polishing procedure, comprising prior to the polishing procedure, contacting the polishing pad with a solution comprised of at least one component for converting at least a portion of a polishing surface of the polishing pad from hydrophobic to hydrophilic, and maintaining the polishing pad in a wet state between the contacting step and the polishing procedure.

2. The method according to claim 1, wherein the polishing pad has pores therein, and the converting converts at least a portion of the pores of at least the polishing surface of the polishing pad from hydrophobic to hydrophilic.

3. The method according to claim 2, wherein substantially all of the pores of the polishing surface of the polishing pad are chemically converted to be hydrophilic.

4. The method according to claim 1, wherein the solution comprises water and from about 5% to about 95% by weight of the at least one component for converting at least a portion of the polishing surface of the polishing pad from hydrophobic to hydrophilic.

5. The method according to claim 1, wherein the at least one component for converting at least a portion of the polishing surface of the polishing pad from hydrophobic to hydrophilic comprises an alcohol.

6. The method according to claim 5, wherein the solution comprises water and from about 5% to 75% by weight of the alcohol.

7. The method according to claim 1, wherein the at least one component for converting at least a portion of the polishing surface of the polishing pad from hydrophobic to hydrophilic comprises isopropyl alcohol.

8. The method according to claim 1, wherein the contacting the polishing pad with the solution comprises soaking the polishing pad in the solution.

9. The method according to claim 8, wherein the soaking is conducted for about 15 minutes to about 3 hours.

10. The method according to claim 1, wherein the method further comprises, following the contacting step, rinsing the polishing pad to substantially remove the solution from the polishing pad.

11. The method according to claim 10, wherein the rinsing with deionized water comprises contacting the polishing surface of the polishing pad with a brushing device in the presence of deionized water.

12. The method according to claim 11, wherein the brushing device comprises a pad or a bristle brush.

13. The method according to claim 10, wherein the rinsing is conducted for about 1 minute to about 1 hour.

14. The method according to claim 1, wherein the method further comprises contacting the polishing pad with a polishing composition subsequent to the contacting step.

15. The method according to claim 14, wherein the contacting the polishing pad with a polishing composition comprises contacting the polishing surface of the polishing pad with a brushing device in the presence of the polishing composition.

16. The method according to claim 14, wherein the contacting the polishing pad with a polishing composition comprises conducting a polishing procedure with the polishing pad in the presence of the polishing composition.

17. The method according to claim 16, wherein the polishing procedure is conducted on a blank run.

18. A method of planarizing a semiconductor substrate surface, comprising seasoning an unseasoned polishing pad comprised of a hydrophobic material by contacting the polishing pad with a solution comprised of at least one component for converting at least a portion of a polishing surface of the polishing pad from hydrophobic to hydrophilic to derive a seasoned polishing pad, maintaining the seasoned polishing pad in a wet state following the seasoning step and before contacting the seasoned polishing pad with a surface of a semiconductor substrate, and contacting the seasoned polishing pad with a surface of a semiconductor substrate to be planarized in the presence of a polishing composition to thereby planarize the semiconductor substrate surface.

19. The method according to claim 18, wherein the polishing composition comprises at least an abrasive material and an etchant.

20. The method according to claim 18, wherein the method further comprises, following the seasoning step, rinsing the polishing pad to substantially remove the solution from the polishing pad.

* * * * *